US007094468B2

(12) United States Patent
Sugiura et al.

(10) Patent No.: US 7,094,468 B2
(45) Date of Patent: Aug. 22, 2006

(54) SIZING AGENT FOR CARBON FIBER, AQUEOUS DISPERSION THEREOF, CARBON FIBER TREATED BY SIZING SHEET-FORM OBJECT COMPRISING THE CARBON FIBER, AND CARBON FIBER-REINFORCED COPOSITE MATERIAL

(75) Inventors: Naoki Sugiura, Ichinomiya (JP); Masato Taguchi, Toyohashi (JP); Tadayoshi Saito, Nagoya (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 207 days.

(21) Appl. No.: 10/478,473

(22) PCT Filed: May 24, 2002

(86) PCT No.: PCT/JP02/05053

§ 371 (c)(1), (2), (4) Date: Nov. 21, 2003

(87) PCT Pub. No.: WO02/099180

PCT Pub. Date: Dec. 12, 2002

(65) Prior Publication Data

US 2004/0197565 A1 Oct. 7, 2004

(30) Foreign Application Priority Data

May 25, 2001 (JP) ..... 2001-157035

(51) Int. Cl.

| | |
|---|---|
| ***B32B 9/00*** | (2006.01) |
| ***B32B 27/12*** | (2006.01) |
| ***B32B 27/38*** | (2006.01) |
| ***D06M 15/55*** | (2006.01) |
| ***C08L 63/00*** | (2006.01) |

(52) U.S. Cl. ..... 428/408; 428/413; 523/400; 523/402; 252/8.83

(58) Field of Classification Search ..... None
See application file for complete search history.

(56) References Cited

U.S. PATENT DOCUMENTS

| | | | | |
|---|---|---|---|---|
| 4,648,987 | A * | 3/1987 | Smith et al. | 510/284 |
| 6,368,712 | B1 * | 4/2002 | Kobayashi et al. | 428/367 |

FOREIGN PATENT DOCUMENTS

| | | |
|---|---|---|
| GB | 1543099 | 9/1979 |
| JP | 50-59589 | 5/1975 |
| JP | 53-52796 | 5/1978 |
| JP | 57-15229 | 1/1982 |
| JP | 60-139875 | 7/1985 |
| JP | 61-28074 | 2/1986 |
| JP | 7-197381 | 8/1995 |
| JP | 10-060779 | 3/1998 |
| JP | 2002-013069 | 1/2002 |

OTHER PUBLICATIONS

U.S. Appl. No. 10/478,473, filed Nov. 21, 2003, Sugiura, et al.
U.S. Appl. No. 10/484,493, filed Jan. 22, 2004, Sugiura, et al.

* cited by examiner

*Primary Examiner*—Michael J. Feely
(74) *Attorney, Agent, or Firm*—Oblon, Spivak, McClelland, Maier & Neustadt, P.C.

(57) ABSTRACT

The present invention provides a sizing agent capable of imparting superior resin impregnation and adhesion with resin, and more particularly, a carbon fiber sizing agent that have satisfactory emulsification stability having stable process throughput and minimizes the changes over time in the sized carbon fibers. The carbon fiber sizing agent contains (A) a compound having at least one epoxy group per molecule, (B) an anionic surfactant having an ammonium ion as the counter ion, and (C) a nonionic surfactant wherein, the nonionic surfactant (C) is contained at 1/50 to 1/2 (weight ratio) relative to the anionic surfactant (B).

23 Claims, 1 Drawing Sheet

SIZING AGENT FOR CARBON FIBER, AQUEOUS DISPERSION THEREOF, CARBON FIBER TREATED BY SIZING SHEET-FORM OBJECT COMPRISING THE CARBON FIBER, AND CARBON FIBER-REINFORCED COPOSITE MATERIAL

TECHNICAL FIELD

The present invention relates to a carbon fiber sizing agent, an aqueous dispersion of the same, carbon fibers applied with the carbon fiber sizing agent, a sheet containing these carbon fibers and a carbon fiber-reinforced composite material.

BACKGROUND ART

Since carbon fibers have low ductility and are brittle, they easily become fuzzy as a result of mechanical friction and also lack wettability with respect to matrix resins. Consequently, it is difficult to fully demonstrate the superior properties of carbon fibers when used as reinforcing materials. In order to improve on this, carbon fibers have been treated in the prior art with a sizing agent. Various compounds are known to function as sizing agents in this manner. For example, Japanese Unexamined Patent Application, First Publication No. Sho 50-59589 discloses the application to carbon fibers of a solvent solution of a sizing agent composed of polyglycidyl ether (to be abbreviated as "Sizing Agent 1"). In addition, Japanese Unexamined Patent Application, First Publication No. Sho 61-28074 describes the formation of an aqueous emulsion of a bisphenol type of polyalkylene ether epoxy compound using a small amount of emulsifier (to be referred to as "Sizing Agent 2"), and this is known to be applied to carbon fibers.

In addition, one example of a fiber-reinforced composite material is a molded article composed by molding a resin composition containing reinforcing material of carbon fiber and a matrix resin. Epoxy resin is widely used as the matrix resin of such fiber-reinforced composite materials. In addition, numerous other resins, including unsaturated polyester resins, vinyl ester resins, acrylic resins and other radical polymerized resins, are also used in addition to epoxy resin.

When obtaining a carbon fiber-reinforced resin composition composed of carbon fibers as the reinforcing material and a matrix resin, examples of methods for impregnating the carbon fibers with the matrix resin include a prepreg method in which carbon fibers are arranged unidirectionally on a matrix resin thinly coated on mold release paper, and a dipping method in which carbon fibers are dipped into a resin bath.

In addition, a carbon fiber-reinforced resin composition can also be obtained by impregnating a matrix resin into a carbon fiber woven fabric after the carbon fibers are processed into a woven fabric with a weaving machine. Examples of methods for obtaining this type of carbon fiber woven fabric-reinforced resin composition include a prepreg method in which carbon fiber woven fabric is layered on a matrix resin thinly coated on mold releasing paper, and a dipping method in which carbon fiber woven fabric is dipped into a resin bath.

In order to mold a stable fiber-reinforced composite material of high quality on an industrial scale, it is necessary that impregnation of carbon fiber bundles composed of several thousand filaments and matrix resin is able to be carried out easily and completely in the impregnation process in which carbon fibers are impregnated with matrix resin.

However, since carbon fibers have low ductility and are brittle, they easily become fuzzy as a result of mechanical friction and also lack wettability with respect to matrix resins. Consequently, it is difficult to allow carbon fibers used as a reinforcing material to fully demonstrate their superior properties as described above. In order to improve on this, carbon fibers used as reinforcing materials of fiber-reinforced composite materials have conventionally been treated with a sizing agent. That is, as a result of treating carbon fibers with a sizing agent, in addition to improving the handling ease of the carbon fibers, their wettability with respect to matrix resin is also improved. As a result, the quality of molded articles composed of a fiber-reinforced composite material using carbon fibers as a reinforcing material is improved. Various compounds are used as sizing agents in this manner.

For example, a sizing agent that uses a polyglycidyl ethers, etc. (to be referred to as "Sizing Agent 3"), is proposed (see Japanese Examined Patent Application, Second Publication No. Sho 57-15229). In addition, a sizing agent having as essential components an epoxy resin and a condensation product of the alkylene oxide adduct of bisphenols with an unsaturated dibasic acid, and the alkylene oxide adduct of phenols selected from a monocyclic phenol and a polycyclic phenol (to be referred to as "Sizing Agent 4") is proposed (Japanese Unexamined Patent Application, First Publication No. Sho 53-52796, Japanese Unexamined Patent Application, First Publication No. Hei 7-197381). In addition, various other sizing agents are also proposed including a sizing agent composed of an epoxy resin, the alkylene oxide adduct of a monocyclic or polycyclic phenol, an unsaturated dibasic acid or its ester-forming derivative and polyester condensation product of the alkylene oxide adduct of bisphenols, which has an acid value of 40 or less (to be referred to as "Sizing Agent 5") (Japanese Unexamined Patent Application, First Publication No. 10-60779).

The aforementioned Sizing Agent 3 has the advantage of superior impregnation and interface adhesive force at the time of use. Sizing Agent 4 is able to improve adhesion with matrix resin, and particularly unsaturated polyester resin. In addition, in the case of using epoxy resin for the matrix resin, Sizing Agent 4 is superior in terms of being able to alleviate the problem of the conventional art of fluctuations in physical properties of carbon fiber-reinforced resin compositions due to fluctuations in curing conditions. In addition, Sizing Agent 5 remains stable over time and has superior unwinding properties, while also exhibiting satisfactory adhesion with unsaturated polyester.

However, since Sizing Agent 1 uses a solvent solution, it had the disadvantage of poor industrial handling and safety considerations in comparison with aqueous types when used to treat carbon fiber sizing agents. In addition, although Sizing Agent 2 improves on the disadvantages of Sizing Agent 1, it was found to have the disadvantages indicated below depending on the selection of the emulsifier. That is, since the emulsion stability of the epoxy compound is inadequate in the case in which the emulsifier is a nonionic surfactant, during treatment for applying a carbon fiber sizing agent, a portion of the emulsion is destroyed resulting in the occurrence of defects by sizing agents and other problems in the carbon fiber production process.

In addition, in the case of an anionic surfactant having an electrical charge that is capable of improving emulsion stability, when the anionic surfactant is that in which the counter ion is an alkaline metal or alkaline earth metal ion, these alkaline metal or alkaline earth metal ions end up contaminating the fiber-reinforced composite material resulting in problems such as decreased thermal stability.

On the other hand, in the case of an anionic surfactant in which the counter ion is an ammonium ion, since this type of surfactant has reactivity with epoxy groups, it gradually reacts with epoxy groups of the adhered sizing agent after adhering to the carbon fibers as sizing agent. As a result, the problem occurred in which the carbon fibers become hard, causing prominent changes over time. Moreover, in the case of a cationic surfactant which also has an electrical charge and is similarly capable of improving emulsion stability, there is the disadvantage of being more expensive than anionic surfactants.

Moreover, since Sizing Agent 3 does not have adequate adhesion with unsaturated polyester resin, vinyl ester resin, acrylic resin and other radical polymerized resins, it is unsuitable for using these resins as the matrix resin of a carbon fiber-reinforced resin composition. In addition, although Sizing Agents 4 and 5 are superior to Sizing Agent 3 in terms of adhesion to radical polymerized resins, the level of adhesion is still not adequate. Consequently, there are still problems with using these resins as the matrix resin of a carbon fiber-reinforced resin composition.

DISCLOSURE OF INVENTION

In order to overcome the aforementioned problems of the conventional art, an object of the present invention is to provide a carbon fiber sizing agent having satisfactory resin impregnation of carbon fibers and satisfactory resin adhesion, stable process throughput and imparts effects that improve physical properties.

An object of the present invention is to provide a carbon fiber sizing agent that causes minimal changes over time in carbon fibers.

An object of the present invention is to provide a carbon fiber sizing agent that improves resin impregnation by not only epoxy resin, but also radical polymerized resins such as acrylic resin, unsaturated polyester resin and vinyl ester resin, while also improving adhesion with these resins.

In addition, an object of the present invention is to provide a carbon fiber sizing method in which sizing is carried out using the aforementioned sizing agent, carbon fibers treated with this sizing agent, a sheet containing carbon fibers treated with this sizing agent, and a fiber-reinforced composite material containing as reinforcing material carbon fibers treated with this sizing agent or a sheet containing these carbon fibers.

The present invention is a carbon fiber sizing agent comprising: (A) a compound having at least one epoxy group per molecule, (B) an anionic surfactant having an ammonium ion as the counter ion, and (C) a nonionic surfactant; wherein, the nonionic surfactant (C) is contained at 1/50 to 1/2 (weight ratio) relative to the anionic surfactant (B).

In addition, compound (A) is an ester of an epoxy compound having a plurality of epoxy groups per molecule and an unsaturated monobasic acid, and has at least one unreacted epoxy group per molecule.

BEST MODE FOR CARRYING OUT THE INVENTION

Figure 1:
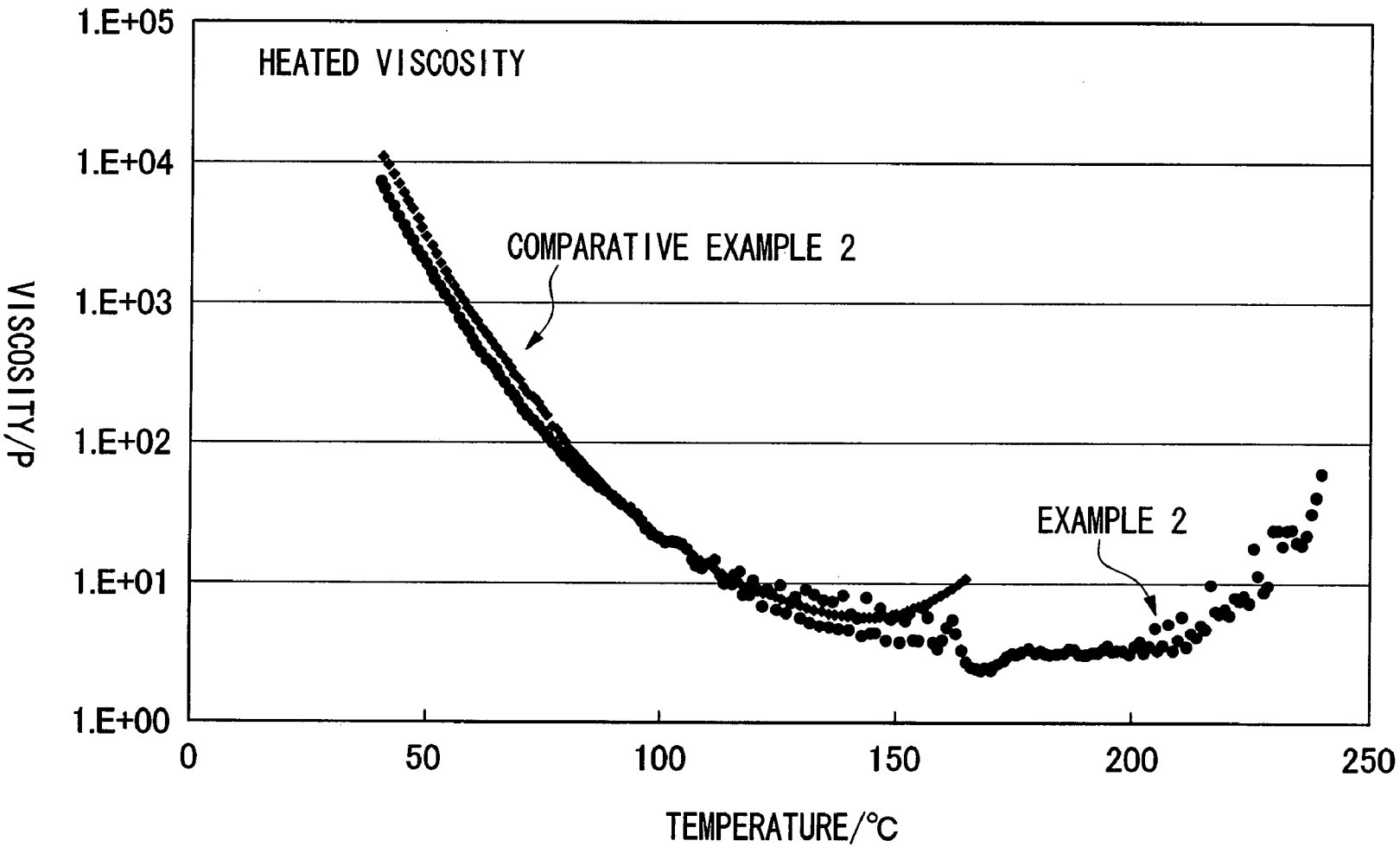
FIG. 1 is a graph showing the typical changes in heated viscosity of examples and comparative examples of the sizing agent of the present invention.

The carbon fiber sizing agent of the present invention is characterized by containing: (A) a compound having at least one epoxy group per molecule, (B) an anionic surfactant having an ammonium ion as the counter ion, and (C) a nonionic surfactant; wherein, the nonionic surfactant (C) is contained at 1/50 to 1/2 (weight ratio) relative to the anionic surfactant (B). Therefore, the reactivity of the ammonium ion originating in anionic surfactant (B) with respect to the epoxy group can be decreased. As a result, changes over time in carbon fibers adhered with sizing agent can be significantly inhibited.

"Nonionic Surfactant (C)"

There are no particular restrictions on the nonionic surfactant (C) used in the present invention. Aliphatic nonionic surfactants are preferable since their action of decreasing reactivity is extremely superior. Examples of aliphatic nonionic surfactants include adducts of higher alcohol ethylene oxide, adducts of fatty acid ethylene oxide, adducts of polyvalent alcohol fatty acid ester ethylene oxide, glycerol fatty acid esters, fatty acid esters of sorbitol and sorbitan and fatty acid esters of pentaerythritol.

Among these adducts of ethylene oxide, those types that contain a propylene oxide unit in a portion of the polyethylene oxide chain either randomly or in block form are used preferably.

Adducts of higher alcohol ethylene oxide, adducts of fatty acid ethylene oxide and adducts of polyvalent alcohol fatty acid ester ethylene oxide that contain a propylene oxide unit in a portion of the polyethylene oxide chain either randomly or in block form are more preferable. This is because they have a superior ability to lower the reactivity of the ammonium ion relative to the epoxy group.

Monoester types, diester types and triester or tetraester types can also be used as adducts of fatty acid ethylene oxide or adducts of polyvalent alcohol fatty acid ester ethylene oxide.

In the present invention, although anionic surfactant (B) contains 1/50 to 1/2 (weight ratio) of the nonionic surfactant (C) to be described later, this is necessary in order to lower the reactivity of the ammonium ion originating in (B) with respect to the epoxy group. If the amount of nonionic surfactant (C) is less than 1/50, the desired effect of lowering the reactivity of the ammonium ion becomes inadequate. On the other hand, if the amount of nonionic surfactant (C) exceeds 1/2, the stability of emulsification decreases, and the advantage of using an anionic surfactant having an ammonium ion as the counter ion for an emulsifier is lost. The lower limit of the added amount of nonionic surfactant (C) is preferably 1/10 and more preferably 1/5 (weight ratios in both cases) with respect to the anionic surfactant (B) having an ammonium ion as the counter ion. On the other hand, the upper limit of the added amount of nonionic surfactant (C) is preferably 1/3 and more preferably 1/4 (weight ratios in both cases) with respect to the anionic surfactant (B) having an ammonium ion as the counter ion.

"Anionic Surfactant (B) Having Ammonium Ion as Counter Ion"

There are no particular restrictions on the anionic surfactant (B) having an ammonium ion as the counter ion used in the present invention, examples of which include carboxylates, sulfate esters, sulfonates and phosphate esters. Among these, sulfate esters and sulfonates are preferable since their ability to emulsify epoxy resin compounds is particularly superior.

Examples of the aforementioned sulfate esters include higher alcohol sulfate esters, higher alkyl polyethylene glycol ether sulfate esters, alkyl benzene polyethylene glycol ether sulfate esters, polycyclic phenyl ether polyethylene glycol ether sulfate esters, and fatty acid sulfate esters.

In addition, higher alcohol polyethylene glycol ether sulfate esters, alkyl benzene polyethylene glycol ether sulfate esters and polycyclic phenyl ether polyethylene glycol ether sulfate esters in which a propylene oxide unit is contained in a portion of the polyethylene oxide chain either randomly or in block form can also be used.

Examples of the aforementioned sulfonates include alkyl benzene sulfonates, alkyl naphthalene sulfonates, polycyclic phenyl ether sulfonates, alkyl sulfonates, α-olefin sulfonates, α-fatty acid sulfonates and dialkyl sulfosuccinates.

More preferably, the hydrophobic group of the anionic surfactant has the structure of formula 1 or formula 2. Carbon fibers have the characteristic of expressing superior mechanical properties as a result of being compounded with resin. Consequently, resins having an aromatic skeleton are used for the resin combined as the matrix resin in consideration of rigidity, and the main components of carbon fiber sizing agents are frequently those that have an aromatic skeleton. In the emulsification of such compounds, the hydrophobic group of the emulsifier has a high affinity with aromatics. As a result, the emulsification product is stable and leads to favorable results in the production process during carbon fiber production. Moreover, during compounding with a matrix resin, the sizing agent component becomes dispersed in the matrix resin, and at the interface layer in particular, a region is formed in which the sizing agent component is contained at a high concentration in the matrix resin component. This region has a considerable effect on the mechanical properties of the compound material. Thus, superior compatibility between the emulsifier and matrix resin is an extremely important characteristic for expressing mechanical properties of the compound material. Moreover, from the viewpoint of extrinsic endocrine disrupter derivatives, it is also becoming necessary to avoid using anionic surfactants having a phenol group containing comparatively long alkyl groups such as nonyl phenyl- and octylphenyl-based anionic surfactants. Under such circumstances, anionic surfactants having a hydrophobic group represented with formula 1 or formula 2 have superior affinity and compatibility with the main composite compounds of sizing agents and matrix resin composite compounds. Consequently, anionic surfactants represented with formula 1 or formula 2 have superior emulsifying ability, superior emulsified product stability and superior expression of the mechanical properties of the compound material.

Formula 1

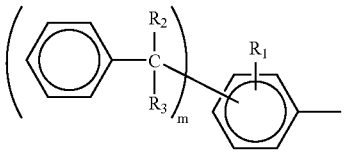

Formula 2

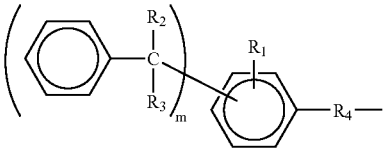

Here, $R_1$ represents a hydrogen atom or linear hydrocarbon group having 1 to 3 carbons, and more preferably a hydrogen atom or methyl group. $R_2$ and $R_3$ represent hydrogen atoms or a linear hydrocarbon groups having no more than 3 carbons. $R_4$ represents a bivalent aliphatic hydrocarbon group. In addition, the number of aromatic rings m substituted on the phenyl group is preferably 1 to 3 and more preferably 1 to 2. If m is greater than 3, then the hydrophobic group itself becomes a highly bulky structure resulting in lower affinity and compatibility with the main composite compound of the sizing agent and matrix resin composite compound. As a result, there are decreases in emulsification stability, resin impregnation characteristics and mechanical properties attributable to the interface characteristics of the compound material. The aromatic compound substituted on the phenyl group is preferably a benzyl group or styrene group from the viewpoint of bulkiness of the molecules of the hydrophilic group portion. In addition, the substituents on the phenyl group may be the same or may consist of a mixture of substituents. These substitution groups are preferably selected from groups other than alkyl group substituents from the viewpoint of extrinsic endocrine disrupter derivatives.

The blended amount of anionic surfactant (B) having an ammonium ion as the counter ion is preferably 5 to 30% by weight of the total weight of components (A) through (C) since this results in satisfactory emulsification stability of the sizing agent without having a detrimental effect of the sizing agent. The lower limit of the blended amount of anionic surfactant (B) is preferably 10% by weight, and the upper limit is preferably 25% by weight.

"Compound (A) Having at Least One Epoxy Group per Molecule"

There are no particular restrictions on compound (A) having at least one epoxy group per molecule used in the present invention. Examples of compound (A) include epoxy compounds of bisphenols, epoxy compounds of alkylene oxide adduct of the bisphenols, epoxy compounds of hydrogenated bisphenols and epoxy compounds of alkylene oxide adduct of hydrogenated bisphenols. Here, there are no particular restrictions on the bisphenols, and examples include bisphenol F. bisphenol A and bisphenol S. In addition, phenol novolak, cresol novolak, diphenyl, dicyclopentadiene and naphthalene skeleton epoxy resins can also be used as applicable components in addition to epoxy compounds of bisphenols. Moreover, those having a linear aliphatic skeleton may also be used.

In addition, examples of epoxy groups include glycidyl and cyclic aliphatic epoxy groups. Here, cyclic aliphatic epoxy groups have a structure like that shown in Formula 3.

Formula 3

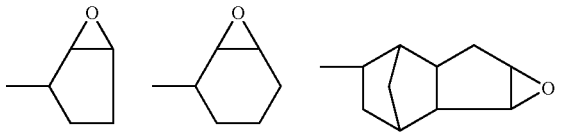

In the present invention, a compound having at least one epoxy group within the molecule of (A) is contained in order to improve the interface adhesion between the carbon fibers and matrix. The aforementioned effect is even larger in the case of a compound having a plurality of epoxy groups.

In addition, in the case of a compound having a plurality of epoxy groups, a some of the epoxy groups may be modified and the other functional group may be introduced. For example, compounds of a type that are modified by esterification of an unsaturated monobasic acid or unsaturated dibasic acid have the effect of improving interface adhesion with vinyl ester resin and unsaturated polyester resin since they have an epoxy group and an unsaturated group within their molecules.

Moreover, esters of compounds having epoxy groups on both terminals in the manner of diepoxy compounds of bisphenols and alkylene oxide addition diepoxy compounds of bisphenols that have an unsaturated group on one terminal of the main chain of the molecule and an epoxy group on the other terminal have an extremely high coupling function between the surface of carbon fibers and resin molecules. As a result, they are capable of powerfully coupling carbon fibers with radical polymerized resins such as unsaturated polyester resin, vinyl ester resin and acrylic resin, allowing the expression of superior interface adhesion.

Although there. are no particular restrictions on the unsaturated monobasic acid here, acrylic acid or methacrylic acid is preferable since the alkyl group bonded to the unsaturated group is not bulky, and the rigidity of the main chain of the formed ester compound is not lowered.

On the other hand, aliphatic based unsaturated dibasic acids having 4 to 6 carbons are preferable for the unsaturated dibasic acid used in the present invention. The use of an aromatic unsaturated dibasic acid raises the melting point of the resulting ester compound and reduces solubility with the matrix resin. As a result, satisfactory wettability is unable to be demonstrated. On the other hand, the use of an aliphatic based unsaturated dibasic acid having 7 or more carbons causes the rigidity of the resulting ester compound to be lost while also lowering affinity with the matrix resin.

In the present invention, compound (A) having at least one epoxy group per molecule may be used alone or as a mixture of a plurality of such compounds.

"Ester Compound of Alkylene Oxide Adduct of Bisphenols with Unsaturated Dibasic Acid Having an Acid Value of 50 or More"

In the present invention, by adding an ester compound of alkylene oxide adduct to bisphenols with unsaturated dibasic acid having an acid value of 50 or more, the wettability of the carbon fibers with resin can be improved. An ester compound having an acid value of 50 or more is used preferably for this ester compound. Consequently, this ester compound has a molecular weight of about 1000, and has as its major constituent component a compound having a carboxyl group on one terminal. Such compounds have extremely superior compatibility with matrix resin, and as a result, are able to impart superior wettability to the carbon fibers.

Alkylene oxide adduct to bisphenols (D) that forms this ester compound is preferably that in which 2 to 4 moles of ethylene oxide or propylene oxide are added to bisphenols. If 5 moles or more of ethylene oxide or propylene oxide are added to bisphenols, the bisphenols lose their inherent rigidity of the molecular chain, resulting in poor affinity with matrix resin. More preferably, 2 moles of ethylene oxide or propylene oxide are added to bisphenols. These alkylene oxide adducts of bisphenols (D) may be used alone or as a mixture of a plurality of such compounds.

Unsaturated dibasic acid that forms an ester with alkylene oxide adducts of bisphenols (D) is preferably an aliphatic based unsaturated dibasic acid having 4 to 6 carbons. If an aromatic based unsaturated dibasic acid is used, the melting point of the resulting ester compound rises and solubility with the matrix resin becomes poor. As a result, satisfactory wettability cannot be demonstrated. On the other hand, if an aliphatic based unsaturated dibasic acid having 7 or more carbons is used, the rigidity of the resulting ester compound is lost and the affinity with the matrix resin may decrease. It is preferable to bisphenols are adducted with 2 to 4 moles of ethylene oxide or propylene oxide in the diepoxy compound of alkylene oxide adduct of the bisphenols that form the ester compound having at least one epoxy group per molecule as well for the reasons previously mentioned. More preferably, 2 moles of ethylene oxide or propylene oxide are adducted with bisphenols.

"Other Compounds"

In the present invention, ester compounds, urethane compounds, polyamide compounds, polyimide compounds and etc. may also be added within a range that does impair the aforementioned effects.

"Sizing Agent Aqueous Dispersion"

The sizing agent of the present invention is applied to the carbon fibers in the form of an aqueous dispersion dispersed in water. The use of the sizing agent in the form of an aqueous dispersion dispersed in water is superior to the case of dissolving in an organic solvent both industrially and in terms of safety.

The sizing agent liquid of the present invention allows compound (A) having at least one epoxy group per molecule to be stably dispersed in water due to anionic surfactant (B) having ammonium ion as counter ion. Consequently, the sizing agent liquid has satisfactory handling ease due to this satisfactory stability.

The blended amount of anionic surfactant (B) is preferably 5 to 30% by weight of the total weight since this results in satisfactory emulsification stability of the sizing agent liquid without having a detrimental effect of the sizing agent. The lower limit of the blended amount of anionic surfactant (B) is more preferably 7% by weight, while the upper limit is even more preferably 20% by weight.

"Carbon Fibers Treated with the Sizing Agent"

The carbon fibers of the present invention have the aforementioned sizing agent applied to their surfaces. The treated carbon fibers may be obtained from any raw material substances such as pitch, rayon or polyacrylonitrile, and may be high strength type carbon fibers (low elastic modulus carbon fibers), medium-high elasticity carbon fibers or ultra-high elasticity carbon fibers.

The applied amount of sizing agent to the carbon fibers is preferably 0.1 to 5% by weight with respect to the weight of the carbon fibers, and more preferably 0.2 to 3.0% by weight. This is because carbon fibers can be obtained that are given adequate convergence and fretting resistance, have wettability and interface adhesion with resin, and the resulting carbon fiber to reinforced resin composition has satisfactory dynamic properties.

"Sizing Agent Application Method"

Production of the carbon fibers of the present invention can be carried out by applying the sizing agent or dispersion of the sizing agent to the carbon fibers by a roller impregnation method or roller contact method followed by drying. At that time, the amount of sizing agent applied can be adjusted by adjusting the concentration of sizing agent or adjusting the amount of pressing. Drying can be carried out with hot air, hot plate, heated rollers or various types of infrared heaters.

"Sheet Using Carbon Fibers and Carbon Fiber-Reinforced Compound Material"

The carbon fibers of the present invention are resistant to the formation of fuzzy due to mechanical friction and have superior wettability and adhesion with respect to matrix resin as a result of being applied with the aforementioned sizing agent. Moreover, application of the aforementioned sizing agent lowers the reactivity of ammonium ion originating in (B) with respect to the epoxy group. As a result, the carbon fibers of the present invention significantly inhibit changes over time in carbon fibers adhered with sizing agent.

Such carbon fibers have superior processing throughput in terms of weaving, cutting and etc., and can be suitably processed into woven fabrics, unidirectional oriented sheets, non-woven fabrics, mats and other sheet materials. In the case of weaving in particular, although carbon fibers normally become fuzzy due to abrasion, the carbon fibers of the present invention are capable of significantly inhibiting the formation of fuzz due to the aforementioned sizing agent.

In a sheet using the carbon fibers of the present invention, there are no particular restrictions on the woven fabric, examples of which include plain weave fabric, twilled weave fabric, satin weave fabric and variations of these. In addition, both the warp and the weft may be composed of the aforementioned carbon fibers. Examples of fibers other than carbon fibers include inorganic fibers such as glass fibers, Tyranno fibers, SiC fibers, and organic fibers such as aramid, polyester, PP, nylon, polyimide and vinylon fibers.

The carbon fiber-reinforced resin composition of the present invention is characterized by the use of the aforementioned carbon fibers. The aforementioned carbon fibers are compounded with matrix resin to compose a carbon fiber-reinforced resin composition in the form of, for example, a unidirectional prepreg, cross prepreg, tow preg, monofilament-reinforced resin-impregnated sheet or monofilament mat-reinforced resin-impregnated sheet.

Although there are no particular restrictions on the matrix resin used here, examples of resins that can be used include epoxy resin and radical polymerized resins such as acrylic resin, vinyl ester resin, unsaturated polyester resin, thermoplastic acrylic resin and phenol resin.

Ordinary methods can typically be employed for producing this type of carbon fiber-reinforced resin composition, examples of which include the hot melt method, solvent method, syrup method or methods such as the thickening resin method used for sheet mold compounds (SMC). During production of the carbon fiber-reinforced resin composition, carbon fibers treated with the aforementioned sizing agent are used, and these fibers are impregnated with the aforementioned matrix resin.

In this type of carbon fiber-reinforced resin composition, since carbon fibers treated with the aforementioned sizing agent are used, the carbon fibers exhibit superior impregnation with the matrix resin in the form of an epoxy resin, acrylic resin, unsaturated polyester resin, vinyl ester resin or other radical polymerized resin as well as phenol resin, there is strong interface adhesion between the carbon fibers and matrix resin, and they exhibit satisfactory dynamic properties.

The following provides a more detailed explanation of the present invention through its examples.

(Measurement of Starting Temperature of Increasing Viscosity)

Starting temperature of increasing viscosity was measured to evaluate the reactivity of the sizing agent.

Each sizing agent composition was mixed at 90° C. (however, since Newcore 560S is an aqueous solution containing 30% by weight of active ingredient, it was used after vacuum-drying to remove the water). After mixing, the sizing agents were cooled to 50° C. followed by measurement of heated viscosity based on a heating rate of 2° C./minute starting at 50° C. using the DSR-200 Rheometer (Rheometrics Far East Ltd.) and recording of the temperature at which viscosity increases.

(Preparation of Sizing Agents)

The sizing agents were prepared by phase inversion emulsification using the Hivis Disper Mix (Tokushu Kika Kogyo Co., Ltd, homomixer specifications, Model 3D-5). The emulsification procedure is explained in detail below.

The majority of the anionic surfactants were 30 to 50% by weight aqueous solutions.

First, the predetermined primary agent and additives were kneaded and mixed with a planetary mixer and homomixer at 100° C. Subsequently, the mixture was heated in the kneaded state to 90° C. followed by the gradual addition of small amounts of an aqueous solution of anionic surfactant. In this step, the viscosity of the contents increased gradually. After adding all of the aqueous anionic surfactant solution, the mixture was heated to 80° C. while kneading well for 10 minutes. Next, small amounts of deionized water were dripped, and after passing the phase inversion point, the amount of water dripped in was increased. An emulsion was ultimately obtained containing about 40% by weight of active ingredient.

(Application of Sizing Agents to Carbon Fibers)

The sizing agents were emulsified in water by phase inversion emulsification. The concentration of sizing agent in the sizing agent aqueous dispersions was expressed while including surfactant.

Pyrofil TR50SX carbon fiber bundles not treated with sizing agent (Mitsubishi Rayon Co., Ltd., carbon filaments: 12,000, strand strength: 5,000 MPa, strand elastic modulus: 242 GPa) were immersed in an immersion tank having free rollers inside an immersion tank filled with an aqueous dispersion of each sizing agent. Subsequently, the carbon fiber bundles were dried with hot air and wound around a bobbin. The properties of the sizing agent in the sizing step were evaluated as "O" in the case of no adhesion of resin to the surface of the immersion rollers and favorable emulsification stability, or "X" in the case of slight adhesion of resin to the surface of the immersion rollers and decreased emulsification stability.

(Fabrication of Unidirectional Prepregs)

63 carbon fiber bundles unwound from the bobbin were uniformly pulled out and arranged on mold release paper coated with B stage epoxy resin #350 (Mitsubishi Rayon Co., Ltd.) and impregnated into epoxy resin by passing through hot pressing rollers. A protective film was then layered thereon to fabricate a unidirectional (UD) prepreg having a resin content of about 30% by weight, carbon fiber weight density of 100 g/m$^2$ and width of 500 mm.

Release and unwinding of the carbon fiber bundles from the bobbin during the aforementioned production process of the UD prepreg were evaluated as "O" in the case of favorable unwinding from the bobbin, no fuzz, favorable opening property of the strand and no adhesion of resin to guide bars, or "X" in the case of thread breakage during release from the bobbin, formation of fuzzy, presence of defects from opening property of the strand and adhesion of resin to guide bars. In addition, the appearance of the UD prepreg and manner absorbing (quality of resin impregnation) when the protective film was peeled off were evaluated as "O" in the case of absence of color defects caused by non-impregnated sections, favorable smoothness and favorable resin absorption, or "X" in the case of absence of color defects caused by non-impregnated sections, favorable smoothness and slow resin absorption.

(Compounding with Radical Polymerized Resin)

A plain weave cross was woven having a carbon fiber weight density of 315 g/m$^2$ composed of 5 warps/inch and 5 wefts/inch using sized carbon fiber bundles.

Next, the crosses were impregnated with vinyl ester resin or unsaturated polyester resin to prepare sheet composite materials having a fiber volume content $V_F$ of about 45%. These eight sheets were layered, heated, and pressed to produce a laminated sheet which was then used as a test piece. Furthermore, the resins used were as indicated below.

1. Vinyl ester resin: Neopor 8260/Permek N/6% cobalt naphthenate=100/1/0.5, curing conditions: 60° C.×2 hr->80° C.×2 hr->120° C.×2 hr
2. Unsaturated polyester resin: U-Pica 4521PT/Permek N=100:1, curing conditions: after leaving at room temperature for one night and 60° C.×2 hr+80° C.×2 hr+120° C.×2 hr (0° and 90° Bending Test and Interlaminar Shear Strength (ILSS))

The interface adhesion between the carbon fibers and matrix resin was evaluated in compliance with the 0° and 90° bending test of ASTM-D-790, which is a typical evaluation method for the mechanical properties of laminated sheets, by forming a UD laminated sheet having a thickness of 2 mm using the UD prepreg. In addition, the interlaminar shear strength (ILSS) of this laminated sheet was evaluated in compliance with the interlaminar shear strength test of ASTM-D-2344.

(Synthesized Ester Compounds)

Bisphenol A type epoxy resin (EP828, Yuka Shell Epoxy KK) is reacted with methacrylic acid and a mixture (A1) of EP828, EP828 single-terminal methacrylic acid-modified epoxy resin (half-ester) and EP282 both-terminals methacrylic acid-modified epoxy resin (diester) mixed at a ratio of 1/2/1 was obtained An ester compound (i) having an acid value of 55 and an ester compound (ii) having an acid value of 30 were respectively obtained by reacting the ethylene oxide 2 molar adduct of bisphenol A (Sanyo Chemical Industries, Ltd.) with maleic anhydride. Moreover, an ester compound (iii) having an acid value of 52 was obtained by reacting the ethylene oxide 6 molar adduct of bisphenol A (Sanyo Chemical Industries, Ltd.) with maleic anhydride.

(Compounds Used for Sizing Agents)

The compounds used are shown in Table 1.

TABLE 1

| | Name | Substance | Supplier |
|---|---|---|---|
| (A) | Epicoat 828 | Bisphenol A type epoxy resin, liquid at room temperature | Japan Epoxy Resin Co., Ltd |
| | Epicoat 1001 | Bisphenol A type epoxy resin, solid at room temperature | Japan Epoxy Resin Co., Ltd |
| | Epiclon N-740 | Phenol novolak type epoxy resin, semi-solid at room temperature | Dainippon Ink and Chemicals, Inc. |
| | A1 | Bisphenol A type epoxy resin modified with methacrylic acid on one terminal | Mitsubishi Rayon Co., Ltd. |
| | Newcore 560SF | Polyoxyethylene nonyl phenyl ether sulfate ester ammonium salt | Nippon Nyukazai Co., Ltd. |
| | Newcore 723SF | Polyoxyethylene polycyclic substituted phenyl ether sulfate ester ammonium salt | Nippon Nyukazai Co., Ltd |
| (C) | ISEO | Adduct of isostearyl alcohol ethylene oxide 6 molar | Aoki Oil Industrial Co., Ltd |
| | CDIS-400 | Diisostearate polyethylene glycol | Nikko Chemicals Co., Ltd. |
| | (i) | Ethylene oxide 2 molar addition product of bisphenol A and maleic anhydride (acid value: 55) | Mitsubishi Rayon Co., Ltd. |
| | (ii) | Ethylene oxide 2 molar addition product of bisphenol A and maleic anhydride (acid value: 30) | Mitsubishi Rayon Co., Ltd. |
| | (iii) | Ethylene oxide 6 molar addition product of bisphenol A and maleic anhydride (acid value: 52) | Mitsubishi Rayon Co., Ltd. |

EXAMPLES 1 TO 6 AND COMPARATIVE EXAMPLES 1 TO 5

Each of the evaluations was carried out using the various sizing agents shown in Tables 2 and 3. Those results are shown in Tables 4 and 5.

TABLE 2

| | Sizing Agent Composition (parts by weight) | Example 1 | Example 2 | Example 3 | Example 4 | Example 5 | Example 6 |
|---|---|---|---|---|---|---|---|
| (A) | Epicoat 828 | 40 | | 32 | | | |
| | Epicoat 1001 | 40 | | — | | | |
| | Epiclon N-740 | — | | 50 | | | |
| | A1 | | 32 | | 32 | 32 | 32 |
| (B) | Newcore 560SF | 15 | 15 | 15 | 15 | | 15 |
| | Newcore 723SF | | | | | 15 | |

TABLE 2-continued

| Sizing Agent Composition (parts by weight) | | Example 1 | Example 2 | Example 3 | Example 4 | Example 5 | Example 6 |
|---|---|---|---|---|---|---|---|
| (C) | ISEO | 5 | 3 | | 3 | 3 | 3 |
| | CDIS | — | | 3 | | | |
| Ester compound | (i) | | 50 | | | 50 | |
| | (ii) | | | | 50 | | |
| | (iii) | | | | | | 50 |

Since Newcore 560SF is an aqueous solution containing 30% by weight of active ingredient, it was prepared by basing the weight ratio of sizing agent on the active ingredient.

TABLE 3

| Sizing Agent Composition (parts by weight) | | Comp. Ex. 1 | Comp. Ex. 2 | Comp. Ex. 3 | Comp. Ex. 4 | Comp. Ex. 5 |
|---|---|---|---|---|---|---|
| (A) | Epicoat 828 | 43 | | 35 | 40 | 42.8 |
| | Epicoat 1001 | 42 | | — | 35 | 42 |
| | Epiclon N-740 | — | | 50 | — | — |
| | A1 | | 35 | | | |
| (B) | Newcore 560SF | 15 | 15 | 15 | 15 | 15 |
| | Newcore 723SF | | | | | |
| (C) | ISEO | — | — | — | 10 | 0.2 |
| | CDIS | — | | — | — | — |
| Ester compound | (i) | | 50 | | | |
| | (ii) | | | | | |
| | (iii) | | | | | |

Since Newcore 560SF is an aqueous solution containing 30% by weight of active ingredient, it was prepared by basing the weight ratio of sizing agent on the active ingredient.

TABLE 4

| | Ex. 1 | Ex. 2 | Ex. 3 | Ex. 4 | Ex. 5 | Ex. 6 |
|---|---|---|---|---|---|---|
| Starting temperature of increasing viscosity (° C.) | A 230 | A 210 | B 170 | A 220 | A 220 | A 200 |
| Sizing agent concentration (% by weight) | 2.1 | 1.8 | 2.0 | 1.8 | 1.8 | 1.8 |
| Amount applied to carbon fibers (% by weight) | 1.0 | 0.7 | 0.8 | 0.7 | 0.7 | 0.7 |
| Sizing step | O | O | O | O | O | O |
| UDPP step | O | O | O | O | O | O |
| Prepreg | B | A | B | B | A | B |
| Epoxy resin (#350) 90° bending strength (MPa) | 148 | 147 | 143 | 145 | 149 | 140 |

Starting Temperature of Increasing Viscosity:

A: 200° C. or higher

B: 160° C. or higher

C: Lower than 160° C.

Sizing Step:

O: No adhesion of resin to surface of immersion rollers, favorable emulsification stability X: Slight adhesion of resin to the surface of the immersion rollers and decreased emulsification stability UDPP Step:

O: Favorable unwinding from the bobbin, no fuzz, favorable opening property of the carbon fiber strand and no adhesion of resin to guide bars X: Thread breakage during release from the bobbin, formation of fuzz, presence of defects coming from opening property of the strand and adhesion of resin to guide bars Prepreg:

A: Absence of color defects caused by non-impregnated sections, favorable smoothness and extremely favorable resin absorption B: Absence of color defects caused by non-impregnated sections, favorable smoothness, favorable resin absorption C: Absence of color defects caused by non-impregnated sections, favorable smoothness and slow resin absorption

TABLE 5

| | Comp. Ex. 1 | Comp. Ex. 2 | Comp. Ex. 3 | Comp. Ex. 4 | Comp. Ex. 5 |
|---|---|---|---|---|---|
| Starting temperature of increasing viscosity (° C.) | C 140 | C 140 | C 130 | A >250 | C 145 |

TABLE 5-continued

| | Comp. Ex. 1 | Comp. Ex. 2 | Comp. Ex. 3 | Comp. Ex. 4 | Comp. Ex. 5 |
|---|---|---|---|---|---|
| Sizing agent concentration (% by weight) | 2.0 | 1.8 | 2.1 | 2.2 | 2.0 |
| Amount applied to carbon fibers (% by weight) | 0.9 | 0.7 | 0.9 | 1.2 | 0.9 |

TABLE 5-continued

| | Comp. Ex. 1 | Comp. Ex. 2 | Comp. Ex. 3 | Comp. Ex. 4 | Comp. Ex. 5 |
|---|---|---|---|---|---|
| Sizing step | O | O | O | X | O |
| UDPP step | O | O | O | O | O |
| Prepreg | B | A | B | C | B |
| Epoxy resin (#350) 90° bending strength (MPa) | 150 | 148 | 145 | 135 | 148 |

Starting Temperature of Increasing Viscosity:

A: 200° C. or higher

B: 160° C. or higher

C: Lower than 160° C.

Sizing Step:

O: No adhesion of resin to surface of immersion rollers, favorable emulsification stability X: Slight adhesion of resin to the surface of the immersion rollers and decreased emulsification stability UDPP Step:

O: Favorable unwinding from the bobbin, no fizz, favorable opening property of the strand and no adhesion of resin to guide bars X: Thread breakage during release from the bobbin, formation of fizz, presence of defects coming from opening property of the strand and adhesion of resin to guide bars Prepreg:

A: Absence of color defects caused by non-impregnated sections, favorable smoothness and extremely favorable resin absorption B: Absence of color defects caused by non-impregnated sections, favorable smoothness, favorable resin absorption C: Absence of color defects caused by non-impregnated sections, favorable smoothness and slow resin absorption

EXAMPLES 2, 4 AND 6 AND COMPARATIVE EXAMPLE 1

The bending properties of cross-laminated sheets were evaluated using vinyl ester resin and unsaturated polyester resin for the matrix resin. The evaluation results are shown in Table 6.

TABLE 6

| | Vinyl ester resin | | | Unsaturated polyester resin | | |
|---|---|---|---|---|---|---|
| Type of Sizing Agent | Bending strength MPa | Bending elastic modulus GPa | ILSS MPa | Bending strength MPa | Bending elastic modulus GPa | ILSS MPa |
| Example 2 | 870 | 43 | 45 | 740 | 39 | 35 |
| Example 4 | 830 | 42 | 42 | 690 | 37 | 33 |
| Example 6 | 800 | 44 | 40 | 650 | 38 | 31 |
| Comp. Ex. 1 | 610 | 41 | 34 | 315 | 39 | 30 |

In addition, typical changes in the heated viscosity of examples and comparative examples of sizing agents are shown in FIG. 1. A sudden increase in viscosity was observed at a certain temperature at which time reaction of the sizing agent occurred. Moreover, since the examples clearly demonstrated higher reaction starting temperatures, they were determined to be more difficult to react.

INDUSTRIAL APPLICABILITY

The carbon fiber sizing agent of the present invention contains a compound (A) having at least one epoxy group per molecule, which enables superior expression of mechanical properties of a carbon fiber-reinforced composite material, and an anionic surfactant (B) having ammonium ion for its counter ion, which exhibits superior emulsification stability and enables superior expression of heat-resistant characteristics of a carbon fiber-reinforced composite material, while also containing a nonionic surfactant (C), which has the effect of inhibiting the reactivity of ammonium ion with the epoxy group. Consequently, it demonstrates superior impregnation with various types of matrix resins. Moreover, carbon fibers treated with this sizing agent enable changes over time in the carbon fibers to be reduced to an extremely low level. In addition, a sizing agent liquid of the present invention is composed by using anionic surfactant for the aforementioned carbon fiber sizing agent and dissolving or dispersing in water. This is superior industrially and in terms of safety during treatment to impart the effects of the carbon fiber sizing agent. In addition, this sizing agent liquid has satisfactory solution stability and can be handled easily.

Moreover, as a result of containing as active ingredient an ester compound having an unsaturated group and epoxy group per molecule in compound (A), the carbon fiber sizing agent of the present invention demonstrates superior affinity with not only epoxy resin, but also other matrix resins such as radical polymerized resins including acrylic resin, unsaturated polyester resin and vinyl ester resin. Consequently, the wettability of carbon fibers treated with this sizing agent with the aforementioned matrix resins can be improved.

Moreover, a sizing agent containing a special ester compound having an acid value of 50 or more is capable of further improving the wettability with the matrix resin.

The invention claimed is:

1. A carbon fiber sizing agent comprising:

(A) a compound having at least one epoxy group per molecule, (B) an anionic surfactant having an ammonium ion as a counter ion, and (C) a nonionic surfactant;

wherein the nonionic surfactant (C) is contained at 1/50 to ½ (weight ratio) relative to the anionic surfactant (B).

2. A carbon fiber sizing agent according to claim 1, wherein the nonionic surfactant (C) is an aliphatic nonionic surfactant.

3. A carbon fiber sizing agent according to claim 1, wherein the nonionic surfactant (C) is one or more compounds selected from the group consisting of an adduct of higher alcohol ethylene oxide, an adduct of fatty acid ethylene oxide and an adduct of polyvalent alcohol fatty acid ester ethylene oxide.

4. A carbon fiber sizing agent according to claim 1, wherein a compound having at least one epoxy group per molecule (A) is an ester of an epoxy compound having a plurality of epoxy groups per molecule and an unsaturated monobasic acid or unsaturated dibasic acid, and has at least one unreacted epoxy group per molecule.

5. A carbon fiber sizing agent according to claim 1, wherein a compound having at least one epoxy group per molecule (A) is an ester of one or both of a diepoxy compound of a bisphenols and a diepoxy compound of alkylene oxide adduct of the bisphenols, and an unsaturated monobasic acid or unsaturated dibasic acid, the compound (A) has an unsaturated group on one terminal of the main chain per molecule, and the compound (A) has an epoxy group on the other terminal.

6. A carbon fiber sizing agent according to claim 1, which further comprises an ester compound of an alkylene oxide adduct of a bisphenols (D) and an unsaturated dibasic acid, and has an acid value of 50 or more.

7. A carbon fiber sizing agent according to claim 6, wherein 1 mole of the alkylene oxide adduct of a bisphenols (D) is adducted with 2 to 4 moles of ethylene oxide or propylene oxide.

8. A carbon fiber sizing agent according to claim 6, wherein the unsaturated dibasic acid is an aliphatic compound having 4 to 6 carbons.

9. A carbon fiber sizing agent according to claim 1, wherein the anionic surfactant (B) is an anionic surfactant having a hydrophobic group represented by Formula 1 or Formula 2:

Formula 1

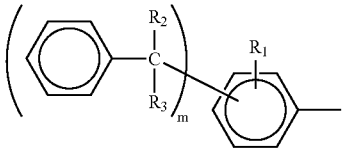

Formula 2

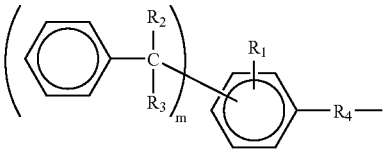

(wherein, $R_1$ represents a hydrogen atom or linear hydrocarbon group having 1to 3 carbons, $R_2$ and $R_3$ each represent hydrogen atom or a linear hydrocarbon group having no more than 3 carbons, $R_4$ represents a bivalent aliphatic hydrocarbon group, and m represents an integer of 1 to 3).

10. Carbon fibers applied with the carbon fiber sizing agent according to claim 1 through 9.

11. Sized carbon fibers according to claim 10, wherein the amount of carbon fiber sizing agent applied is 0.1 to 5% by weight with respect to the carbon fibers.

12. A sheet containing the carbon fibers according to claim 10.

13. A carbon fiber-reinforced composite material containing the carbon fibers according to claim 10.

14. A carbon fiber sizing agent according to claim 1, wherein the nonionic surfactant (C) is contained at 1/10 to ½ (weight ratio) relative to the anionic surfactant (B).

15. A carbon fiber sizing agent according to claim 1, wherein the nonionic surfactant (C) is contained at ⅕ to ½ (weight ratio) relative to the anionic surfactant (B).

16. A carbon fiber sizing agent according to claim 1, wherein the nonionic surfactant (C) is contained at 1/50 to ⅓ (weight ratio) relative to the anionic surfactant (B).

17. A carbon fiber sizing agent according to claim 1, wherein the nonionic surfactant (C) is contained at 1/50 to ¼ (weight ratio) relative to the anionic surfactant (B).

18. Carbon fibers applied with the carbon fiber sizing agent according to claim 14 through 17.

19. Sized carbon fibers according to claim 18, wherein the amount of carbon fiber sizing agent applied is 0.1 to 5% by weight with respect to the carbon fibers.

20. A sheet containing the carbon fibers according to claim 18.

21. A carbon fiber-reinforced composite material containing the carbon fibers according to claim 18.

22. An aqueous dispersion for a carbon fiber sizing agent comprising:

a dispersed compound having at least one epoxy group per molecule (A), an anionic surfactant (B) and a nonionic surfactant (C) in water using the anionic surfactant (B) as an emulsifier;

wherein the nonionic surfactant (C) is contained at 1/50 to ½ (weight ratio) relative to the anionic surfactant (B).

23. An aqueous dispersion for a carbon fiber sizing agent according to claim 22, wherein the anionic surfactant (B) used as an emulsifier is present at 5 to 30% by weight of the weight of all components excluding water.

* * * * *